US007059008B2

(12) United States Patent
Morgan et al.

(10) Patent No.: US 7,059,008 B2
(45) **Date of Patent: *Jun. 13, 2006**

(54) CLEANING BRUSH WITH REPLACEABLE/DISPOSABLE BRUSH HEAD

(75) Inventors: Terra J. Morgan, Oak Creek, WI (US); Douglas A. Soller, Racine, WI (US); Kenneth W. Michaels, Spring Grove, IL (US); Peter M. Neumann, Racine, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/702,890

(22) Filed: Nov. 6, 2003

(65) Prior Publication Data

US 2005/0246848 A1 Nov. 10, 2005

(51) Int. Cl.
*A47K 11/10* (2006.01)

(52) U.S. Cl. ..... 15/210.1; 15/150; 15/223; 15/147.1

(58) Field of Classification Search ..... 15/228, 15/229.1, 229.2, 229.6, 229.11, 229.13, 209.1, 15/210.1, 147.1, 150, 226, 223
See application file for complete search history.

(56) References Cited

U.S. PATENT DOCUMENTS

| | | | | |
|---|---|---|---|---|
| 245,585 | A | 8/1881 | Tracy | |
| 1,631,791 | A | 6/1927 | Buckley | |
| 1,993,215 | A | 3/1935 | Hoyt et al. | |
| 2,079,709 | A | 5/1937 | Heider | 15/150 |
| 2,290,894 | A | 7/1942 | Rivanov | |
| 2,318,094 | A | 5/1943 | Petzold, Jr. et al. | |
| 2,755,497 | A | 7/1956 | Greacen, Jr. | |
| 3,496,616 | A | 2/1970 | Vazquez | |
| 3,605,161 | A * | 9/1971 | Moss et al. | 15/150 |
| 3,789,451 | A | 2/1974 | Laitner | |
| 4,031,673 | A | 6/1977 | Hagelberg | |
| 4,755,421 | A | 7/1988 | Manning et al. | |
| 4,964,186 | A | 10/1990 | Stuck | |
| 5,115,535 | A | 5/1992 | Ferre et al. | |
| 5,630,243 | A | 5/1997 | Federico et al. | |
| 5,970,587 | A | 10/1999 | Knox | |
| 6,094,771 | A * | 8/2000 | Egolf et al. | 15/210.1 |
| 2002/0007527 | A1 | 1/2002 | Hart | |
| 2003/0074757 | A1 | 4/2003 | Brinker | |
| 2004/0129296 | A1* | 7/2004 | Treacy et al. | 134/6 |
| 2005/0005378 | A1* | 1/2005 | Soller et al. | 15/104.94 |

FOREIGN PATENT DOCUMENTS

| | | |
|---|---|---|
| GB | 651454 | 4/1951 |
| GB | 23293325 | 9/2001 |

* cited by examiner

*Primary Examiner*—Gladys J P Corcoran
*Assistant Examiner*—Shay L. Balsis

(57) ABSTRACT

Disclosed is a brush for cleaning toilet bowls and the like. The brush has a permanent handle and can be used with a replaceable/disposable brush head that is flushable after use. The brush is a stack of sheets of water-dissolvable material. The sheets are compressed to both bind them together into a stack. There is a longitudinal slit in the rear of the brush head to create left and right rear attachment tabs. A wand provides a remote system for clamping and unclamping the brush head. The wand has a jaw whose mouth has two wedge shaped teeth that are offset from each other to clamp the corresponding tabs while driving the tabs in opposite directions in the jaw.

14 Claims, 6 Drawing Sheets

CLEANING BRUSH WITH REPLACEABLE/DISPOSABLE BRUSH HEAD

CROSS-REFERENCE TO RELATED APPLICATIONS

Not applicable.

STATEMENT REGARDING FEDERALLY SPONSORED RESEARCH

Not applicable

FIELD OF THE INVENTION

The present invention relates to brushes that are used for cleaning. It appears particularly well suited for providing improved toilet brushes.

BACKGROUND OF THE INVENTION

Toilet brushes are typically used to swirl cleaning chemicals around a toilet bowl and then to scrub the sides of the bowl with those chemicals and water, so as to assist in removing stains along the bowl sides. Such brushes usually have brush bristles that are permanently affixed to the handle of the brush.

After using such brushes a consumer will typically attempt to rinse off the brush by swirling it in the bowl water. This rinsing process may be repeated through one or more additional rinsing flushes. While this may rinse off most of the cleaning chemicals, feces, urine, and stray bits of paper typically found in the toilet, the brushes still normally retain some contaminants even after extensive rinsing. As a result, such brushes can develop an unpleasant smell or appearance during storage.

Regardless, such brushes will be dripping wet immediately after use. The consumer sometimes will therefore shake the brush over the toilet to try to remove most of the excess water, and then quickly move the brush into a storage bucket. This can result in some liquid being splashed or dripped on the floor. In any event, a storage place for the brush is needed between uses where drippings can collect.

The art therefore designed toilet brushes where permanent brush handles were provided, but the brush heads were formed as disposable and replaceable elements. See e.g. U.S. Pat. Nos. 2,755,497, 4,031,673, 5,630,243, and 6,094,771. See also GB 2,329,325. These brushes were designed so that a small replaceable head could be flushed down the toilet after each use. Some such heads were impregnated with a cleaning composition to avoid the need to separately add a cleaning chemical.

However, these devices typically relied on relatively weak frictional attachments to connect the replaceable brush head to the wand/handle. The head would therefore sometimes accidentally/prematurely fall off during use (before the cleaning was complete, such as during vigorous scrubbing of a stubborn stain).

Also, certain types of such brush heads could cause clogging problems, or be otherwise unsuitable for use with sensitive septic systems. This might be due to the size of the head, or to extra structures (such as cardboard bands) used to hold head parts together.

In other prior art devices, some formed their disposable brush heads from highly water-degradable material. Unfortunately, the material they chose sometimes would begin to fall apart before the cleaning process was completed, particularly when aggressive scrubbing was attempted. Further, such material was so flexible that it made it difficult to transmit scrubbing force from the handle to the brush head portion without risking the handle scratching the bowl sides.

Still other brush assemblies of this type required the consumer to provide a continuous pressure to keep the head in contact with the wand. See e.g. U.S. Pat. Nos. 1,631,791 and 2,290,894. This could lead to hand strain, and in some cases to premature release of the head.

Still other such brushes were difficult to assemble or disassemble. See e.g. U.S. Pat. No. 245,585.

Other devices of this type could not be produced efficiently with automated equipment. With those, the cost of the devices was such as to make them less competitive in the marketplace.

In GB 2,329,325 there was disclosed a toilet brush with a head portion made of a stack of bound sheets of water-dissolvable material. However, this relied on an undesirable adhesive feature, and in any event had other undesirable characteristics.

A number of other prior brush heads had their bristles spread too quickly under brushing force, making scrubbing somewhat more difficult than optimal. Still other brush heads had other deficiencies.

Thus, a need continued to exist for improved toilet brushes having replaceable brush heads.

SUMMARY OF THE INVENTION

In one aspect the invention provides a cleaning implement having a handle having a clamping jaw and a brush head suitable to be held in the jaw. The brush head has a slit extending from a rearward end of the brush head part way forward along the brush head so as to define a left rear and a right rear portion of the brush head. At least one of the left and right rear portions can be pivoted upward relative to a central portion of the brush head while the other of said left and right rear portions can be pivoted downward relative to the central portion.

The jaw has an upper jaw part and a lower jaw part, the upper jaw part having a downwardly projecting tooth, and the lower jaw part having a upwardly projecting tooth. The downwardly projecting tooth and the upwardly projecting tooth are offset relative to each other in a sideways direction. The brush head can be positioned relative to the jaw such that one jaw tooth contacts the left rear portion and the other jaw tooth contacts the right rear portion.

In preferred forms the brush head is formed from a stack of water-degradable material, the cleaning implement is a toilet brush, and the left and right rear portions of the brush head are compressed relative to a frontal portion of the brush head. Also, one of the top or bottom side of the stack can be provided with undulations along the left and right rear portions, where those undulations were formed by compressing the stack.

In other preferred forms the compression of the stack also served to bind an end of the stack together, the stack is a plurality of layers, and a plurality of those layers are formed with bristle segments adjacent a forward end of the stack.

In another form, the invention provides a wand for holding a brush head. The wand has a handle having an internal axial cavity, a lower opening communicating with the cavity, and an activator opening. There is also an actuator having a projection extending through the activator opening, a connecting rod linked to the projection which is mounted in the handle cavity, and a jaw linked to the rod which extends out the handle lower opening.

The jaw has an upper jaw part and a lower jaw part, the upper jaw part having a downwardly projecting tooth, and the lower jaw part having a upwardly projecting tooth. The downwardly projecting tooth and the upwardly projecting tooth are offset relative to each other in a sideways direction. The wand is constructed and arranged such that a first movement of the projection will move the jaw to a first position suitable to release a brush head if the brush head has been inserted in the jaw, and a second movement of the projection will move the jaw to a second position suitable to clamp a brush head if a brush head has been inserted in the jaw.

With respect to such wands the upper and lower jaw parts are connected by a living hinge, the two teeth can be each wedge shaped with the wedges narrowing in a forward direction, and the wand is for holding a brush head so as to form a cleaning implement.

In yet another form the invention provides a brush head suitable to be held by a cleaning device. The brush head has a plurality of layers of a water-degradable material positioned on top of each other in the form of a stack of such layers. It also has a slit extending from a rearward end of the brush head part way forward along the brush head so as to define a left rear and a right rear portion of the brush head.

At least one of the left and right rear portions can be pivoted upward relative to a central portion of the brush head while the other of said left and right rear portions can be pivoted downward relative to the central portion. In the most preferred form the brush head is suitable to be held by a wand portion of a toilet brush.

Water-degradability is a desirable feature because it allows the head to be flushed immediately after use, thereby avoiding the need to transport the dripping head to a garbage can, and avoiding any odors that may develop if the brush head were left in a garbage can for some time period after use. Preferred water-degradability exists where with the degree of mechanical action typical in residential plumbing systems, the material will structurally separate in water into numerous small pieces in a short period.

For purposes of interpreting our claims, we use a standard laboratory test, rather than observing the particular material in a plumbing facility. In this regard, we agitate a standard sample of the material in a tube containing water, by repetitively inverting the tube at a standard speed.

We obtain a transparent tube (e.g. a plastic tube) that is 500 mm in height with an internal diameter of 73 mm. We place in the tube 700 ml of tap water at 23° C. A 100mm× 100 mm sample of the material to be tested (regardless of thickness) is placed in the water and allowed to stand immersed for 30 seconds. During the 30 seconds the tube is stoppered.

The tube is then inverted (rotated 180 degrees), stopped for a second, turned back to the original starting position (180 degrees), and then stopped for a second. Note the reversal of direction, rather than continued rotation in the same direction which might create a centrifugal force which forces the material to a wall. Each cycle takes about four seconds, leading to an average test speed of 15 such cycles per minute.

We then examine whether within five minutes of such agitation the material has at least split into two pieces. If so, the material is considered "water-degradable" for purposes of our claims. Note that it is highly preferred that the material be chosen so that under these conditions, within that five minutes, the material will have broken up into many small pieces. Note that "water-degradable" is not being used in this application in a way that necessarily requires any particular degree of biodegradability (as distinguished from structural degradability under the conditions specified). Of course, for a variety of reasons, biodegradability may well be desirable as well.

While a variety of cellulosic materials have been developed for use as toilet paper, and most toilet papers are water-degradable, stacked plies of conventional toilet paper would not be optimal for these brush heads as such paper is typically designed to degrade much more quickly than desired when used for cleaning bowl sides. It is instead preferred to use a nonwoven fibrous web formed from a blend of cellulosic fibers that are hydroentangled. See U.S. Pat. No. 4,755,421 for a disclosure of such hydroentangled materials.

It is most preferred to use a nonfibrous web which is at least 70% pulp fibers hydroentangled with other selected fibers. Suitable materials are available from Ahlstrom Corporation under the tradenames Hydraspun 784 Flushable Wipes, Hydraspun 8553 Flushable Wipes, Hydraspun 1280 Flushable Wipes, and Hydraspun 1280 Flushable Wipes Apertured Grade. The last of these materials is a somewhat more abrasive material than the other three.

One could one start with a material having a dry thickness of about 500 microns. By forming a two-ply structure of that material one could end up with a thickness of about 1,000 microns.

The brush heads of the present invention could be formed from a single piece of water-degradable material that has been repetitively folded back on itself in accordion fashion. This is one form of a "stack" of material.

Another approach is to take shorter segments of that material, fold them over once (or not at all), and then stack the segments. Either approach creates a stack brush head.

In any event, it is preferred to have between four and forty layers of such material in the stack. Using less than four layers may provide too small a brush head (which takes longer to clean a typical toilet bowl), or require each sheet to be so thick as to be less degradable. Using more than forty layers increases the production cost and (depending on the thickness of the layers) may increase the frequency of clogging the toilet. To achieve any desired level of thickness of a particular layer, one can start with a sheet that is already that thick, or take multiple sheets of less thickness and (by pressing) create a multiple ply layer.

To provide for easier handling, clamping and removal of the brush head, the end of the brush head opposite the bristles should have the layers bonded together. One means of achieving this bonding is by pressure bonding (also known as mechanical quilting) of the type typically used to bond multiple plies of paper towels together. The same compression force that creates the bonding can also create undulations. An alternative is to use a water-dissolvable adhesive such as adhesive H9397 (a hot melt adhesive sold by Bostik Findley), or water-dissolvable threads or staples made of a material such as polyvinyl alcohol.

It is preferred that the rear end be compressed such that at rest the bristle front end will be between 50 and 200% thicker than the part with undulations. When this is the case, the bristle end will tend to spread out/flower an appropriate amount when pushed against the bowl side during a scrubbing motion.

It is preferred for the undulating section to constitute no more than one-half of the head axial length. This permits at least one-half of the length to be used for bristles and spreading thereof.

In other forms the brush head will be at least partially impregnated with a cleaning chemical such as a surfactant.

The chemical might be a mixture of one or more of surfactants known to be effective for toilet bowl or other cleaning (for example most preferably anionic and nonionic in combination, but also possible cationic or zwitterionic). The chemical composition can also include fragrance, dye (for example to dye the head itself or for turning the bowl water a desired color such as blue), preservatives, bleaches, and/or other additives conventional in toilet bowl cleaners (for example abrasives).

Most preferably, any such impregnating chemical will only have a very low percentage, or no, water. For example, the chemical composition could, as applied, have less than 30% water. By using low levels of (or no) water in the cleaning chemical, the cleaner is inhibited from migrating during storage from the interior layers to the exterior layers. Further, the structural integrity of the brush is protected.

The stack is preferably cut with a series of parallel cuts at the forward end, to create bristles. Each bristle could be single-layered, or more preferably be at least a double-layered structure in the form of a loop.

The present invention advantageously provides in various embodiments:

a cleaning implement of the above kind;

a brush head of the above kind that has a relatively stiff rearward portion such that force applied to the rear of the brush head via the brush handle will be efficiently transmitted to the brush head bristles to assist scrubbing;

a brush head of the above kind that can easily be securely mounted in a jaw of a holding wand;

a wand of the above kind that can securely hold such a brush head; and toilet brushes which can be formed from such wands and brush heads that are inexpensive to produce.

These and still other advantages of the present invention will be apparent from the following disclosure. In the following description reference is also made to the accompanying drawings which form a part thereof, and in which there is shown by way of illustration preferred embodiments of the invention. These embodiments do not represent the full scope of the invention. Rather, reference should be made to the claims herein for determining the full scope of the invention.

DETAILED DESCRIPTION OF THE INVENTION

Figure 1:
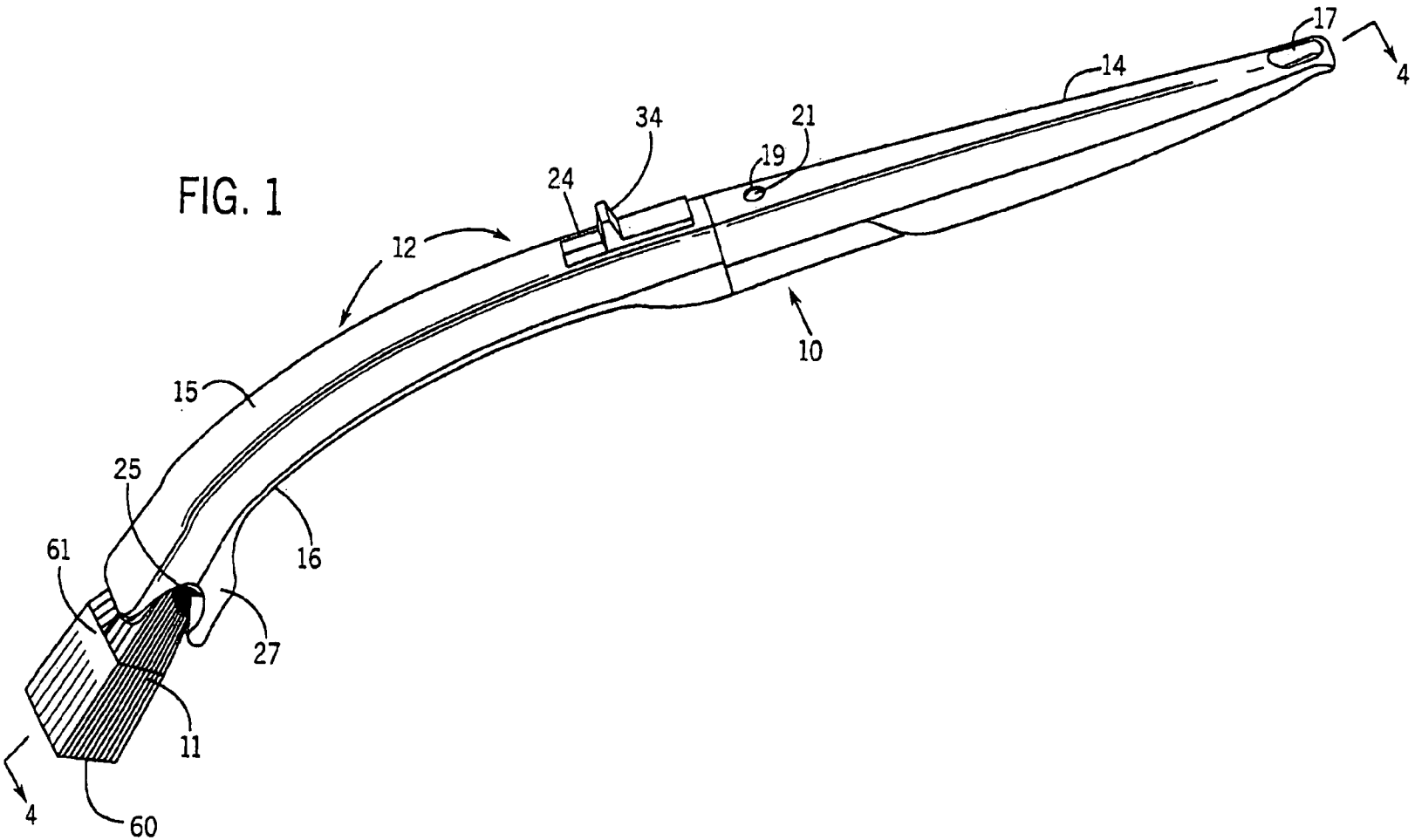
FIG. 1 is a top, frontal, right perspective view of an assembled toilet brush of the present invention.
Figure 2:
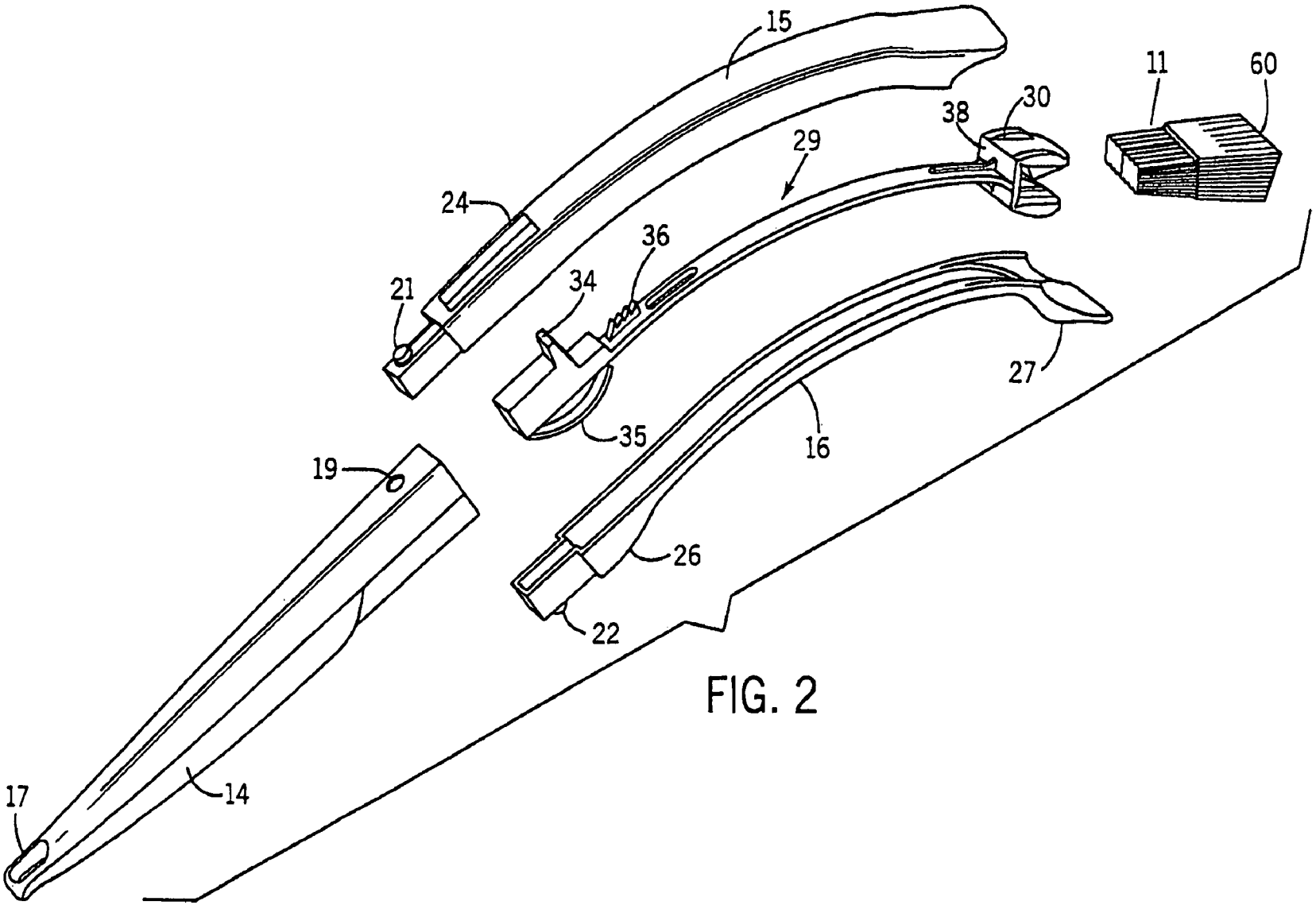
FIG. 2 is an exploded perspective view thereof, albeit taken from the left side.
Figure 3:
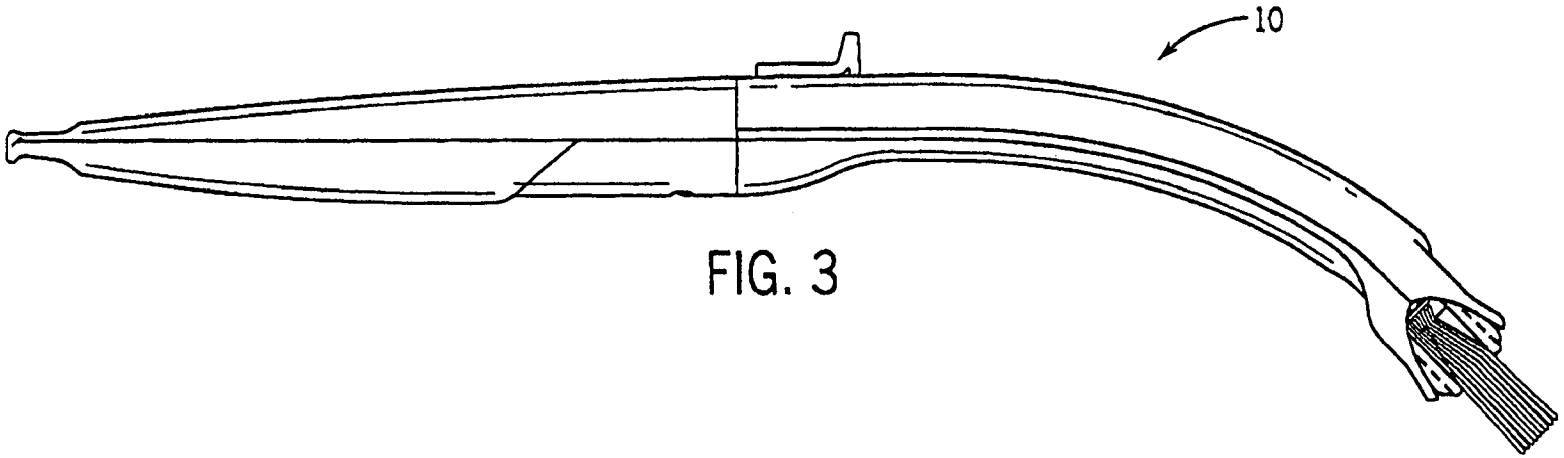
FIG. 3 is a left side elevational view of the FIG. 1 brush.
Figure 4:
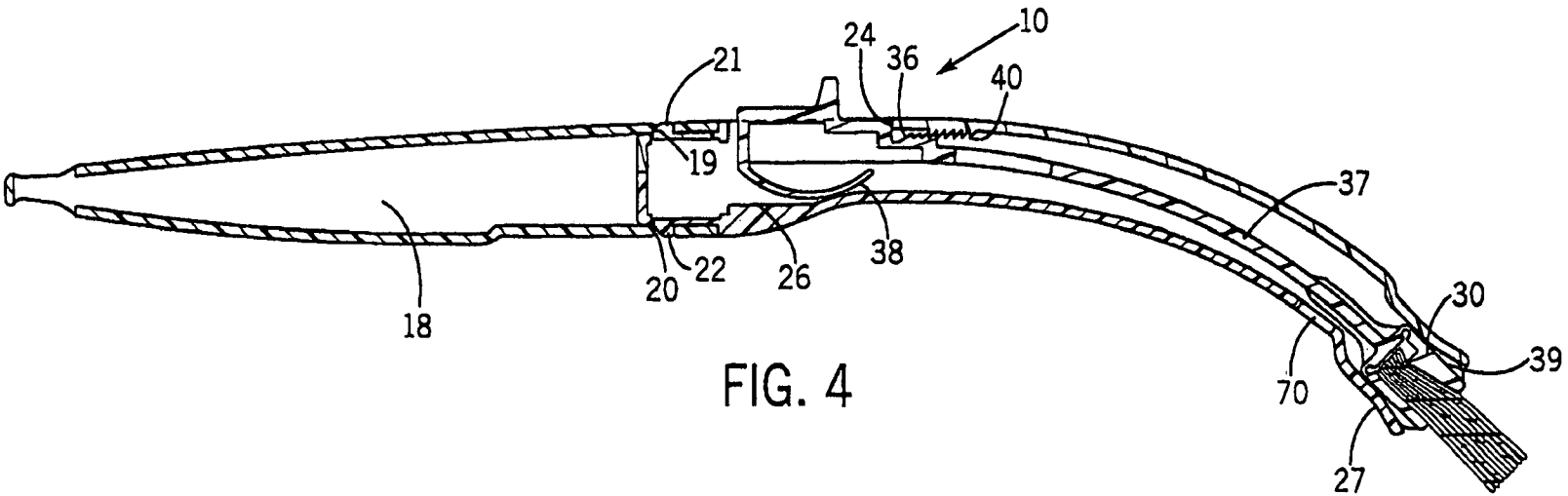
FIG. 4 is a cross sectional view taken along line 4—4 of FIG. 1.

In FIGS. 1–6 there is depicted a toilet brush (generally 10) having a disposable brush head 11 and a multi-part wand/handle (generally 12). FIGS. 2 and 4 depict that the wand 12 can be assembled from an extension 14, and upper and lower clam shell housing parts 15 and 16. The extension 14 is preferably largely hollow to reduce weight, and is formed with a hole 17 for assisting in hanging up the wand 12 (or the wand 12 with an unused brush head 11 connected thereto) between uses (for example on a nail or a hook).

Near the opposite end of the extension 14 are radially extending holes 19 and 20 that are suitable to receive corresponding snap parts 21 and 22 of the housing parts 15 and 16. The housing part 15 has a radial slot 24 on one surface and an arcuate inner channel along its opposite surface. The housing part 16 has a corresponding arcuate inner channel along its upper surface extending to a rear depressed area 26. When the housing parts 15 and 16 are assembled together, they form a somewhat clam shell-like housing with a hollow internal cavity communicating with the slot 24 and a mouth outlet 25 at a lower end.

Prior to assembling the housing parts 15 and 16, an actuator (generally 29) is positioned there between. As shown in FIG. 2, the actuator 29 has a radially outward projecting section 34, a lower flexible spring 35, a series of catch teeth 36, a rod 37 (which is preferably of a cross-shaped cross section to reduce weight and friction), and a flexible jaw 38 having one or more abutment ears 39.

The projection 34 extends through the slot 24, with the spring 35 then abutting housing part 16. From FIG. 5 it can be seen that corresponding teeth 40 are formed on an internal surface of housing part 15.

Once the parts 15 and 16 have sandwiched the actuator 29, that subassembly can be snap fit into the extension 14 via the interaction of the parts 19, 20, 21 and 22. This creates a secure and rigid wand structure.

Figures 5, 6:
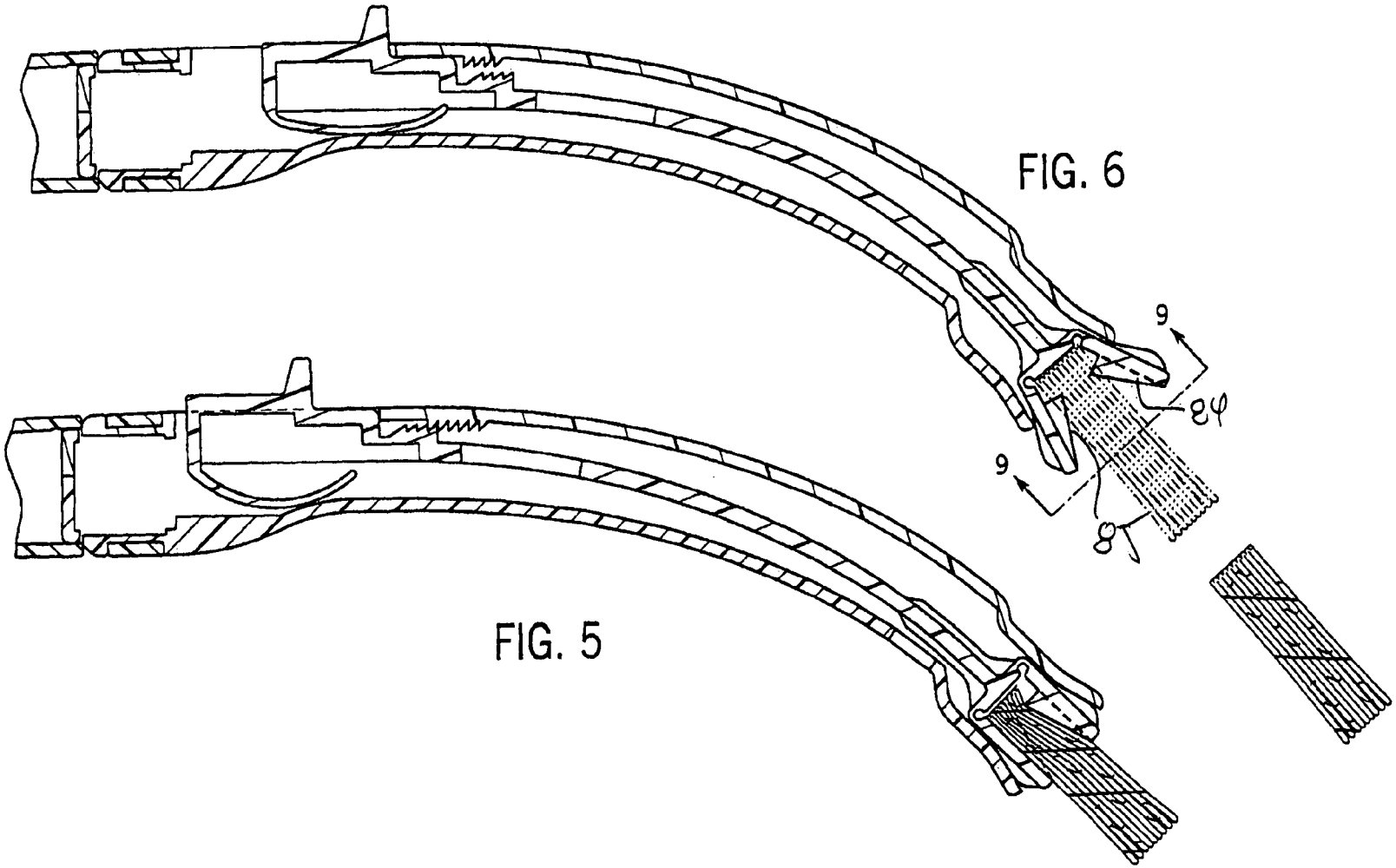
FIG. 5 is an enlargement of a portion of FIG. 4, showing the brush head in the clamped position.
FIG. 6 is a view similar, to FIG. 5, but with the actuator moved such that the clamping jaw has flexed open to permit the release of the brush head.

When the projection 34 is in the FIG. 5 position, teeth 36 are interfit with the teeth 40 such that downward movement of the connecting rod 37 is inhibited. In this position the upper and lower jaws 30 have been driven by the mouth 25 firmly against the rearward portion of the brush 11 of the present invention.

In this configuration the jaws firmly hold the brush head 11, and the control rod 37 is inhibited from accidentally moving in a way that would permit release of the brush head. However, when a consumer pushes radially inward on the projection 34 (compare FIGS. 5 and 6) against the opposing spring pressure, the teeth 36 and 40 will clear each other (see FIG. 6) such that a consumer can then readily push the projection 34 axially towards the handle mouth. Subsequent release of the projection permits the teeth to re-engage.

The actuator 29 is preferably molded from a plastic such as polypropylene which holds a position bias. The jaw portion thereof can be molded with a rest position that is more open than shown in FIG. 6. When the jaws are dragged into the wand mouth 25, they will tend to move towards each other as shown in FIG. 5. However, even a slight release of the wand holding pressure, as shown in FIG. 6, will allow the jaw to flex open, thereby releasing the brush head.

It is expected that the brush head will then be able to easily fall out of the jaw into the toilet bowl for flushing disposal. However, if the brush head tends to hold in place, one can lightly shake the brush head to dislodge it.

When it is desired to reclose the jaw to clamp a replacement brush head, simple axial movement of the projection 34 (without any depressing of it) will achieve this due to the particular sloping of the teeth. Thus, a unidirectional movement of the projection is sufficient to catch a new brush head, while a bidirectional movement is required to create a release. This helps avoid accidental release of the brush head, while making insertion of the replacement brush head easy and intuitive.

Wand parts 14–16 are preferably made of plastic. It is especially preferred that a more flexible plastic be used for actuator 29 than for the outer parts 14–16.

While parts 14–16 are shown as being linked together by a snap fit connection of a type conventional with vacuum cleaner hose parts, a variety of other mechanical means for securing the parts together are possible. For example, there may be some benefits to the use of a bayonet type connection, rather than a simple axial snap connection. Alternatively, the parts 14–16 could be reconfigured as a two-part clam shell, albeit this would be less preferred due to it taking up extra shelf and shipping space prior to purchase by the consumer.

Also, while teeth 36/40 are angled to render clamping of the brush head easier to achieve than release, the teeth could be otherwise angled. For example, rendering them normal to the wand would make it equally difficult to move the connecting rod 33 in either direction, and require radial motion for both to proceed.

Figure 7:
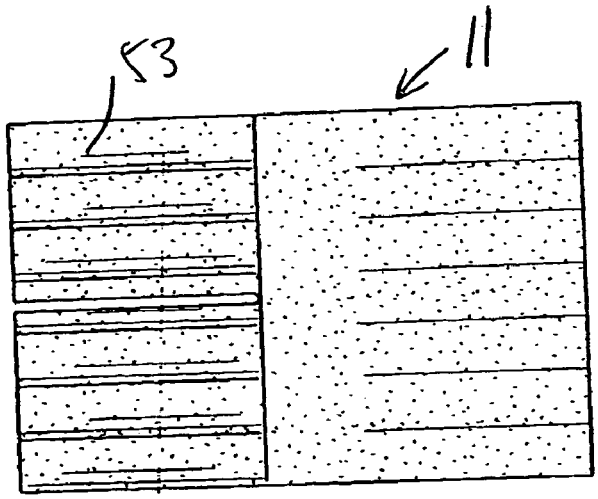
FIG. 7 is a top plan view of the brush head portion of the toilet brush.
Figure 8:
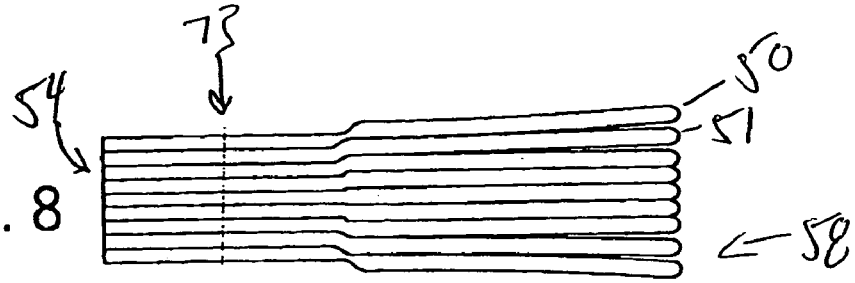
FIG. 8 is a side elevational view thereof.

Particularly now with respect to FIGS. 7 and 8, the brush head 11 is a stack of layers (50, 51, etc.) of water-degradable material. The layers may be folded back on each other once, and then stacked.

The stack has a series of undulations 53 at its rearward end 54 on both the top 73 and bottom 74 of the brush head. The undulations can be formed by a compression roller, with the pressure bonding the layers together in a manner similar to mechanical quilting. Where there are the undulations, the compression of the stack sufficiently bonds the layers of the stack together for the purposes intended, while permitting the forward end 58 to flower outward during brushing.

The stack has the rear end 54 split by a longitudinal cut 80 to define a right rear portion 82 and a left rear portion 81. Prior to cutting the cut 80 the stack can have been rolled at its rearward end with a compression roller so as to create a series of undulations on one or both of the top or bottom surface of the brush head.

Figure 9:
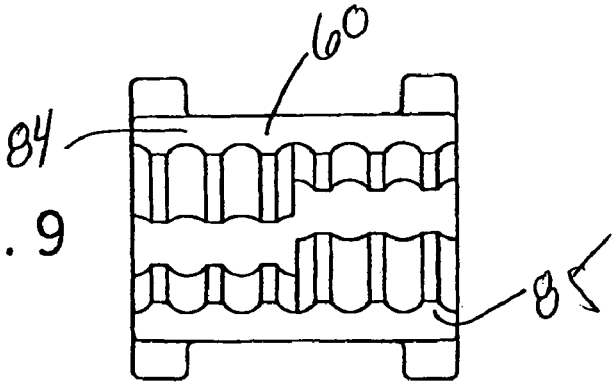
FIG. 9 is an end view of a slightly modified wand jaw.
Figure 10:
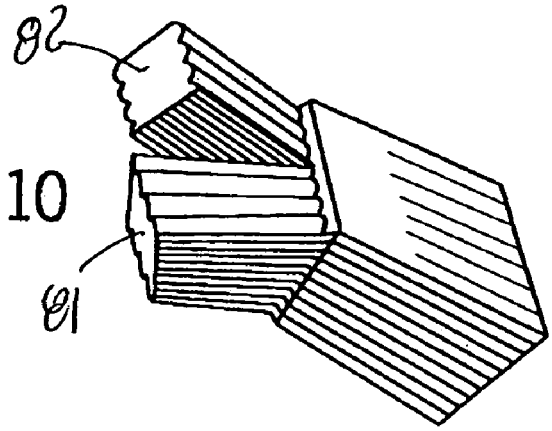
FIG. 10 is a perspective view of the brush head, albeit showing the rear ears pivoted relative to each other.
Figure 11:
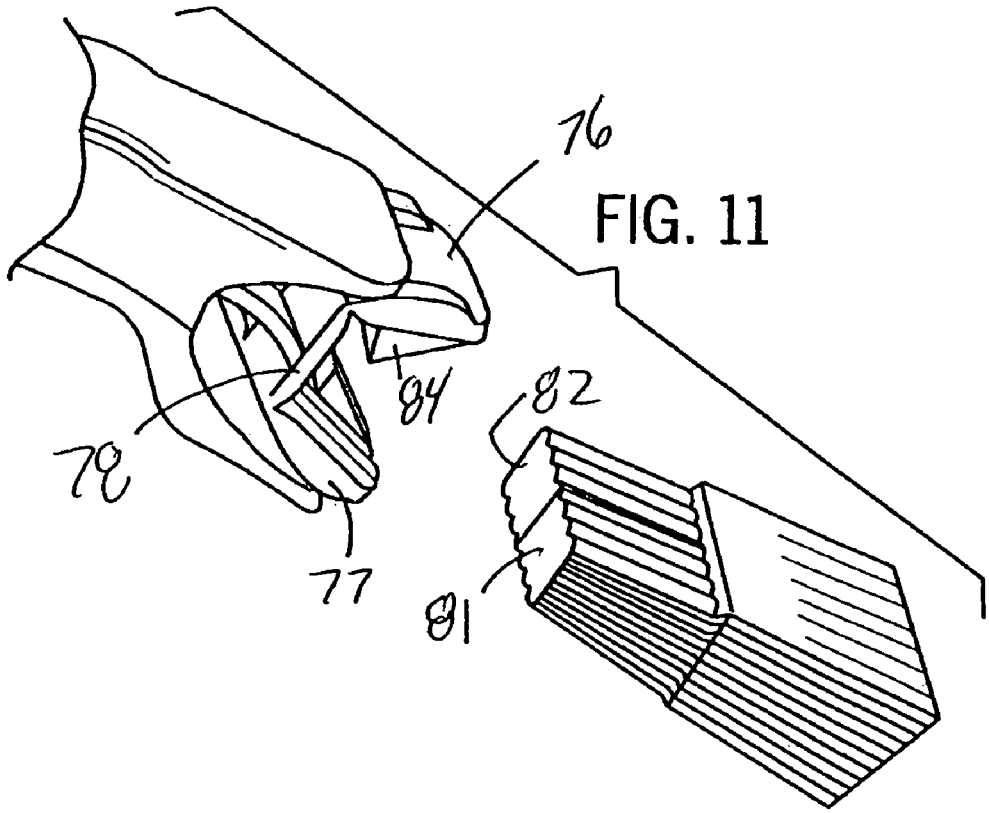
FIG. 11 shows the brush head in the process of being mounted into the wand jaw by movement along a longitudinal axis of the jaw.

As shown in FIG. 9 the jaw can have an upper part 76 and a lower part 77. These are connected by a living hinge 78. The upper jaw has a downwardly projecting wedge shaped tooth 84 which narrows forwardly. The lower jaw has an upwardly projecting wedge shaped tooth 85 which also narrows forwardly.

When the upper end lower jaw parts are closed towards each other the teeth 84/85 are offset sideways from each other, with a slight gap there between. The design is such so as to permit the rear portion 82 to fit in the jaw above the tooth 85 while permitting the rear portion 81 to fit in the jaw below the tooth 84.

As the jaw tightens, it bites into the adjacent undulations. This provides an even more secure connection.

In the most preferred form, the actuator 29 is positioned relative to the outer parts 15/16 such that the wand prevents the jaw from opening so far that something as thick as ears 81 and 82 could fit into the jaw unless then could pivot with respect to each other. This has the advantage that only brush heads having a pivot capability will be able to fit in the jaw, unless the brush head has undesirable features (e.g. is too thin).

Further, the interaction between the teeth and the jaw parts provides firm and secure clamping. Thus, the design is less likely to experience accidentally dropped brush heads than a jaw without the wedges.

While specific embodiments of the invention have been described, additional embodiments are possible without departing from the spirit or scope of the invention. For example, the term "undulation" is not limited to just a smoothly contoured set of waves of uniform dimension. Rather, the undulations could be a series of pointed or more complex projections separated by recesses. Moreover, there could be more than two teeth in the jaw, and more than one longitudinal cut along the brush head.

As such, one skilled in the art will appreciate from the disclosure herein that still other alternative embodiments fall within the scope and breadth of the invention. The claims should be looked to in order to understand the full scope of the invention, and the claims are not to be interpreted to be limited to just the preferred embodiments shown.

INDUSTRIAL APPLICABILITY

Toilet brushes are provided where the brush heads are disposable and replaceable, yet securely held in a brush wand during use.

We claim:

1. A cleaning implement, comprising:

a handle having a clamping jaw; and a brush head suitable to be held in the jaw;

wherein the brush head has a slit extending from a rearward end of the brush head part way forward along the brush head so as to define a left rear and a right rear portion of the brush head such that at least one of the left and right rear portions can be pivoted upward relative to a central portion of the brush head while the other of said left and right rear portions can be pivoted downward relative to the central portion;

wherein the jaw has an upper jaw part and a lower jaw part, the upper jaw part having a downwardly projecting tooth, and the lower jaw part having a upwardly projecting tooth, and the downwardly projecting tooth and the upwardly projecting tooth are offset relative to each other in a sideways direction; and wherein the brush head can be positioned relative to the jaw such that one jaw tooth contacts the left rear portion and the other jaw tooth contacts the right rear portion, with the jaw teeth pivoting the left rear portion of the brush head and right rear portion of the brush head in opposite directions in the jaw.

2. The cleaning implement of claim 1, wherein the brush head is formed from a stack of water-degradable material.

3. The cleaning implement of claim 1, wherein the cleaning implement is a toilet brush.

4. The cleaning implement of claim 1, wherein the left and right rear portions of the brush head are compressed relative to a frontal portion of the brush head.

5. The cleaning implement of claim 4, wherein at least one of a top or bottom side of the stack is provided with undulations along the left and right rear portions.

6. The cleaning implement of claim 5, wherein the undulations were formed by compressing the stack.

7. The cleaning implement of claim 6, wherein the compression of the stack also served to bind an end of the stack together.

8. The cleaning implement of claim 1, wherein the stack is a plurality of layers, and a plurality of those layers are formed with bristle segments adjacent a forward end of the stack.

9. A wand for holding a brush head, the brush head being of the type having a slit extending from a rearward end of the brush head part way forward along the brush head so as to define a left rear and a right rear portion of the brush head such that at least one of the left and right rear portions can be pivoted upward relative to a central portion of the brush head while the other of said left and right rear portions can be pivoted downward relative to the central portion, the wand comprising:

a handle having an internal axial cavity, a lower opening communicating with the cavity, and an activator opening; and an actuator having a projection extending through the activator opening, a connecting rod linked to the projection which is mounted in the handle cavity, and a jaw linked to the rod which extends out the handle lower opening;

wherein the jaw has an upper jaw part and a lower jaw part, the upper jaw part having a downwardly projecting tooth, and the lower jaw part having a upwardly projecting tooth;

wherein the downwardly projecting tooth and the upwardly projecting tooth are offset relative to each other in a sideways direction; and wherein the wand is constructed and arranged such that a first movement of the projection will move the jaw to a first position suitable to release the a brush head if the brush head has been inserted in the jaw, and a second movement of the projection will move the jaw to a second position suitable to clamp the a brush head if the a brush head has been inserted in the jaw, and such that the jaw teeth can pivot the left rear portion and right rear portion in opposite directions in the jaw when the second movement occurs if the brush head has been inserted in the jaw.

10. The wand of claim 9, wherein the upper and lower jaw parts are connected by a living hinge.

11. The wand of claim 9, wherein the two teeth are each wedge shaped with the wedges narrowing in a forward direction.

12. The wand of claim 9, wherein the wand is for holding the a brush head so as to form a toilet cleaning implement.

13. A brush head suitable to be held by a cleaning device, wherein the brush head comprises:

a plurality of layers of a water-degradable material positioned on top of each other in the form of a stack of such layers;

wherein the brush head has a slit extending from a rearward end of the brush head part way forward along the brush head so as to define a left rear and a right rear portion of the brush head such that at least one of the left and right rear portions can be pivoted upward relative to a central portion of the brush head while the other of said left and right rear portions can be pivoted downward relative to the central portion; and wherein the brush has a series of undulations on both its top and bottom surfaces.

14. The brush head of claim 13, wherein the brush head is suitable to be held by a wand portion of a toilet brush.

* * * * *